US006354314B1

(12) United States Patent
Iurincich

(10) Patent No.: US 6,354,314 B1
(45) Date of Patent: Mar. 12, 2002

(54) INFLATABLE UMBRELLA

(76) Inventor: Edoardo Iurincich, Via Lamarmora N. 32 Cap 34100 Trieste (IT)

( * ) Notice: Subject to any disclaimer, the term of this patent is extended or adjusted under 35 U.S.C. 154(b) by 0 days.

(21) Appl. No.: 09/537,189

(22) Filed: Mar. 29, 2000

(51) Int. Cl.[7] ..... A45B 11/00
(52) U.S. Cl. ..... 135/20.2; 135/16
(58) Field of Search ..... 135/15.1, 16, 20.2

(56) References Cited

U.S. PATENT DOCUMENTS 3,863,661 A * 2/1975 Aburto ..... 135/20.2
4,068,675 A * 1/1978 Pappanikolaou ..... 135/20.2
4,370,994 A * 2/1983 Pittman ..... 135/20.2
4,643,210 A * 2/1987 Feld ..... 135/20.2
4,870,983 A * 10/1989 Wang ..... 135/20.2
5,040,555 A * 8/1991 Wang ..... 135/20.2
5,103,848 A * 4/1992 Parsons ..... 135/20.2
5,464,034 A * 11/1995 Kestin ..... 135/202.2
5,699,818 A * 12/1997 Carpenter ..... 135/16
5,725,004 A * 3/1998 Moulder ..... 135/20.2
5,894,855 A * 4/1999 Gefell ..... 135/20.2
5,993,276 A * 11/1999 Ponton ..... 441/130
6,139,382 A * 10/2000 Eschbacher ..... 441/32

* cited by examiner

*Primary Examiner*—Beth A. Stephan
(74) *Attorney, Agent, or Firm*—Varndell & Varndell, PLLC

(57) ABSTRACT

An inflatable umbrella comprises an inflatable hollow umbrella handle, an inflatable hollow umbrella cover, and an inflatable valve; wherein the inner spaces of the umbrella handle and the umbrella cover are interconnected, while inflatable valve is positioned at a proper position of the umbrella. The handle and cover are inflated directly or by means of an air pump through the inflation valve, so that a safe and convenient umbrella is formed.

10 Claims, 2 Drawing Sheets

INFLATABLE UMBRELLA

FIELD OF THE INVENTION

The present invention relates to an inflatable umbrella, especially to an inflatable umbrella made of polyvinyl chloride (PVC), which can be inflated directly or by means of an air pump, and may be come in variety of sizes suitable for adults and children.

BACKGROUND OF THE INVENTION

The prior art umbrella bones or umbrella frame are made of metal material. The umbrella surface is seamed directly to the umbrella bones. As the umbrella is closed or opened, the umbrella bones will possible pierce other people asides due to a careless action, or clamp user's hand. Moreover, as a strong wind blows, the umbrella surface is possible turned upwards, and the umbrella bones may leave from the umbrella cloth so that the umbrella is destroyed and can not be used further. Therefore, the umbrella is necessary to be updated to induce a necessary waste.

SUMMARY OF THE INVENTION

Accordingly, it is a primary object of the present invention to provide a safe, useful, enhanced, portable inflatable umbrella, which can be inflated directly or by means of an air pump.

It is another object of the present invention to provide an inflatable umbrella made of polyvinyl chloride (PVC), which can be come in variety of sizes suitable for adults and children.

In order to achieve the aforesaid objects, the present invention provides an inflatable umbrella, comprising an inflatable hollow handle, an inflatable hollow cover and an inflation valve; wherein the inner spaces of the handle and cover are interconnected. The cross section of the handle has a shape selected from the group of round shape, rectangular shape, triangular shape or other suitable shape. The inflation valve is disposed at a proper position of the umbrella. Optionally, the cover is formed by combination of a plurality of inflatable hollow spoke bones and cloth, the inner spaces of the hollow spoke bones and the handle are interconnected. The cross section of the spoke bones has a shape selected from the group of sound shape, rectangular shape, triangular shape or other suitable shape. In addition, a protrusion as a cap can be formed at the top end of the umbrella Moreover, the cover of the inflatable umbrella of the present invention can be in variety of colors and have a logo or other inscription thereon, to improve the appearance.

The objects and advantages of the present invention will be readily understood from the following detailed description of embodiments with reference to the appended drawings.

DETAILED DESCRIPTION OF THE PREFERRED EMBODIMENTS

Figure 1:
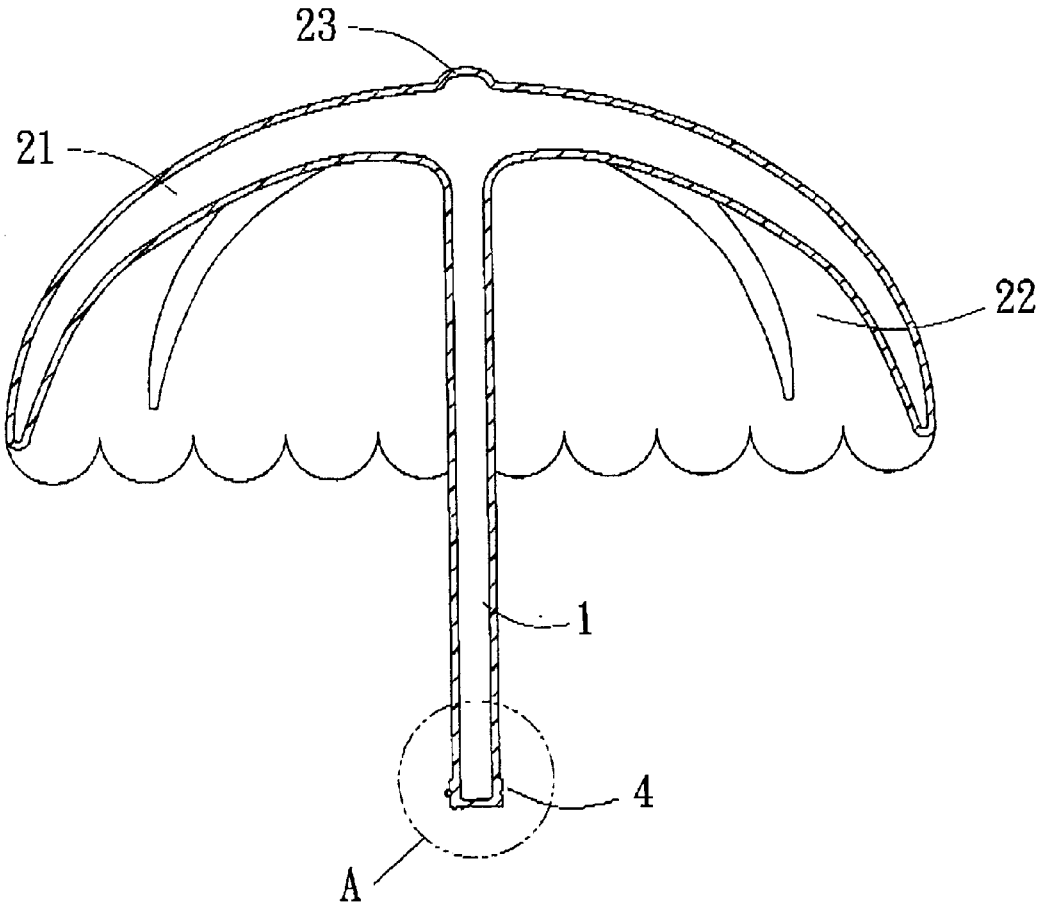
FIG. 1 shows a sectional view of the first embodiment of the present invention in longitudinal direction.
Figure 1A:
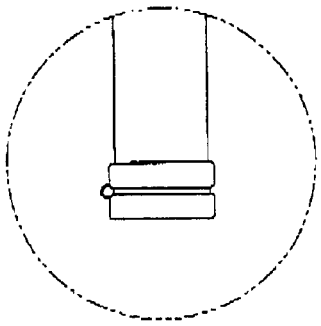
FIG. 1A shows an enlarged section view of the inflation valve of the first embodiment of the present invention in longitudinal direction; wherein the inflation valve is disposed at the lower end of the handle.
Figure 2:
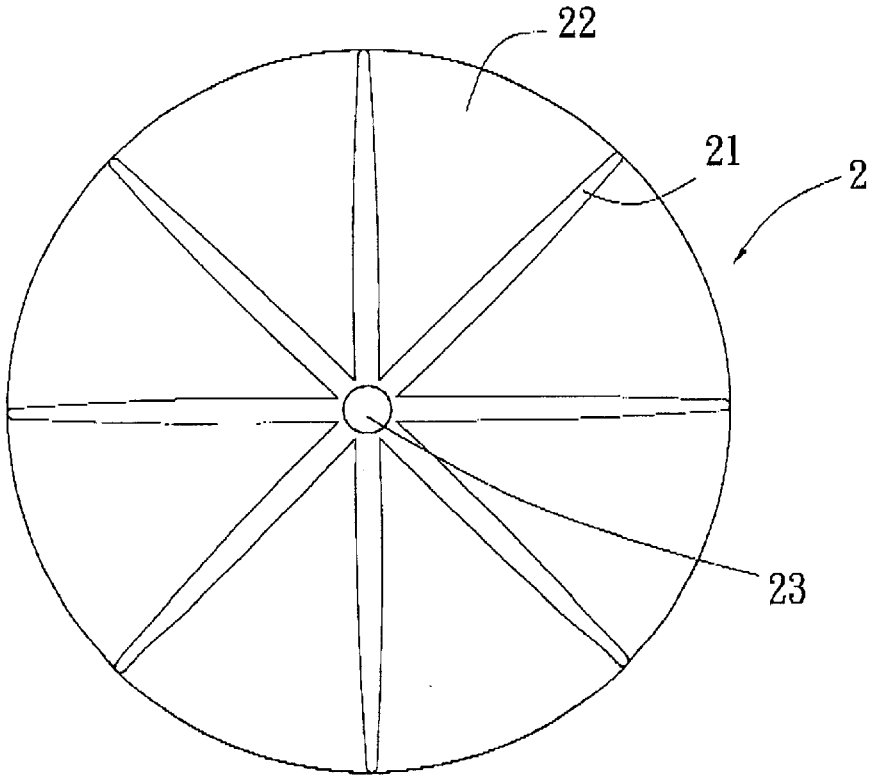
FIG. 2 shows top view of the second embodiment of the present invention.

With reference to FIGS. 1, 1A and 2, the first embodiment of the inflatable umbrella according to the present invention is illustrated. The inflatable umbrella of the present invention includes an inflatable hollow cylindrical umbrella handle 1, a plurality of inflatable spoke hollow cylindrical umbrella bones 21, connecting cloth 22 and an inflatable valve 4. Wherein the umbrella handle, umbrella bones, connecting cloth and inflatable valve are made of polyvinyl chloride (PVC). The inner radius of the spoke cylindrical umbrella bone is reduced gradually from the umbrella top end to the umbrella rim, and then combines with the connecting cloth to be formed as an umbrella cover 2. The inner spaces of the umbrella handle 1 and these spoke umbrella bones 21 are interconnected. The inflatable valve 4 is disposed at lower end of the umbrella handle, and a protrusion 23 is formed at the umbrella top end.

Figure 3:
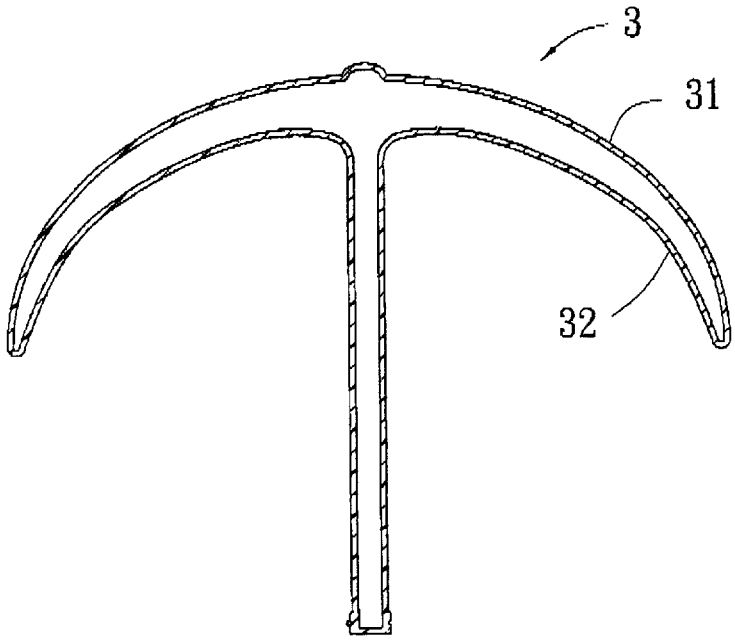
FIG. 3 shows a sectional view of the second embodiment of the present invention in longitudinal direction; wherein the umbrella cover has no umbrella bones.

FIG. 3 shows a longitudinal cross sectional view of the second embodiment according to the present invention. The umbrella cover 3 is formed by a piece of upper umbrella cloth 31 and a piece of lower umbrella cloth 32. The inner space formed by the upper and lower umbrella clothes 31 and 32 is interconnected with the umbrella handle.

If the present invention is to be used, air is pumped into the inner spaces of the spoke cylindrical umbrella bones 21 and the umbrella handle 1, or the space enclosed by the upper and lower umbrella clothes 31 and 32 and inner space of the umbrella handle. Then, an inflatable umbrella is formed.

Although the present invention has been described with reference to the preferred embodiments, it will be understood that the invention is not limited to the detailed described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An inflatable umbrella comprising an inflatable hollow umbrella handle, an inflatable hollow umbrella cover, and an inflatable valve;

the inflatable hollow umbrella handle having an inner space communicating with the inflatable valve; and the inflatable hollow umbrella cover including a plurality of interconnected spoke hollow umbrella bones, the plurality of interconnected spoke hollow umbrella bones communicating with the inner space of the inflatable hollow umbrella handle, a connecting cloth extending across the plurality of interconnected spoke hollow umbrella bones for forming an inner space of the inflatable hollow umbrella cover and providing an umbrella top, the umbrella top forming a convex curvature relative to the inflatable hollow umbrella handle and having a protruding cap extending outward from an apex thereof and communicating with the inner space of the inflatable hollow umbrella cover.

2. The inflatable umbrella as claimed in claim 1, wherein the umbrella handle, umbrella cover and inflatable valve are made of polyvinyl chloride.

3. The inflatable umbrella as claimed in claim 1, wherein the inflatable valve is positioned at the lower end of the umbrella handle.

4. The inflatable umbrella as claimed in claim 1, wherein a cross section of the umbrella handle has a shape selected from the group of round shape, rectangular shape or triangular shape.

5. The inflatable umbrella as claimed in claim 1, wherein a cross section of the spoke hollow umbrella bones is a shape selected from the group of round shape, rectangular shape or triangular shape.

6. An inflatable umbrella comprising an inflatable hollow umbrella handle, an inflatable hollow umbrella cover, and an inflatable valve, wherein:

the inflatable hollow umbrella cover is formed by an upper umbrella cloth and a lower umbrella cloth, the upper umbrella cloth and the lower umbrella cloth respectively having a circumferential edge, the circumferential edges of the upper umbrella cloth and the lower umbrella cloth joined together to form a single inner space extending between the circumferential edges of the upper umbrella cloth and the lower umbrella cloth, and an inner space of the inflatable hollow umbrella handle communicating with the single inner space of the inflatable hollow umbrella cover.

7. The inflatable umbrella as claimed in claim 6, wherein the umbrella handle, umbrella cover and inflatable valve are made of polyvinyl chloride.

8. The inflatable umbrella as claimed in claim 6, wherein the inflatable valve is positioned at the lower end of the umbrella handle.

9. The inflatable umbrella as claimed in claim 6, wherein a cross section of the umbrella handle has a shape selected from the group of round shape, rectangular shape or triangular shape.

10. The inflatable umbrella as claimed in claim 6, wherein a protruding cap is formed at a top center of the upper umbrella cloth.

* * * * *